US006283173B1

(12) United States Patent
Osborne

(10) Patent No.: US 6,283,173 B1
(45) Date of Patent: Sep. 4, 2001

(54) FORECOURT FUEL PUMPS

(76) Inventor: Graham William Osborne, 74 Yarmouth Road, North Walsham, Norfolk (GB), NR28 9AU ( * ) Notice: Subject to any disclaimer, the term of this patent is extended or adjusted under 35 U.S.C. 154(b) by 0 days.

(21) Appl. No.: 09/355,060

(22) PCT Filed: Jan. 23, 1998

(86) PCT No.: PCT/GB98/00209

§ 371 Date: Jul. 22, 1999

§ 102(e) Date: Jul. 22, 1999

(87) PCT Pub. No.: WO98/32693

PCT Pub. Date: Jul. 30, 1998

(30) Foreign Application Priority Data

Jan. 25, 1997 (GB) ..... 97 01553

(51) Int. Cl.[7] ..... B67D 5/32

(52) U.S. Cl. ..... 141/83; 141/94; 417/18; 417/53

(58) Field of Search ..... 417/18, 53; 141/94, 141/83; 73/49.2; 222/27

(56) References Cited

U.S. PATENT DOCUMENTS 3,632,988 * 1/1972 Yamawaki et al. ..... 235/61.7 B
4,576,312 * 3/1986 Swick, Jr. ..... 222/27
4,850,233 * 7/1989 Carlin et al. ..... 73/49.2
5,507,325 * 4/1996 Finlayson ..... 141/83
5,533,890 * 7/1996 Holst et al. ..... 431/5
5,782,275 * 7/1998 Hartsell, Jr. et al. ..... 141/94

* cited by examiner

*Primary Examiner*—Timothy S. Thorpe
*Assistant Examiner*—Ehud Gartenberg
(74) *Attorney, Agent, or Firm*—Andrus, Sceales, Starke & Sawall, LLP

(57) ABSTRACT

A forecourt fuel pump has a casing locating means for metering and delivering to a flexible hose liquid fuel to be dispensed, and a processing unit arranged to monitor and control the delivery of fuel and the display of information concerning that delivery. The pump is provided with at least one sensor for an environmental parameter associated with the pump, such as the sensing of hydrocarbon liquids in the casing. Further sensors external of the pump may be provided to sense other parameters such as the presence of hydrocarbon vapor or liquids. Each sensor provides an output which is supplied to the processing unit which is arranged to monitor the output and provide an indication if the sensed value falls outside a pre-set range.

14 Claims, 2 Drawing Sheets

FORECOURT FUEL PUMPS

This invention relates to a forecourt fuel pump, and in particular to such a fuel pump provided with a processing unit arranged to monitor and control the delivery of fuel as well as the display of information concerning such delivery.

Current designs of forecourt fuel pumps, adapted for the metered delivery of petroleum spirit (petrol) or diesel fuels, are usually provided internally with a processing unit including a microprocessor, in order to facilitate the operation of the pump and the display of information concerning the delivery of fuel. Such a processing unit readily lends itself to this use, especially as the price per unit of fuel delivered is likely to change frequently, and at short notice; a processing unit may be arranged to allow the easy input of information such as the price per unit of fuel delivered, by a site operator.

It is further known, for example from U.S. Pat. No. 5,450,883, to utilise a processor better to control the delivery of fuel by sensing vapour pressures in the pipelines through which the fuel flows in the course of fuel delivery. If then there is a fault in the vapour recovery system of the pump, the processor can automatically take remedial action. Modern microprocessors are extremely powerful and generally are under utilised in process operations such as the control of a forecourt fuel pump. A microprocessor may be configured to handle a large number of input and output lines (i/o lines) through a number of separate ports, and a typical application such as a fuel pump does not require the use of all of the i/o lines and ports which a typical microprocessor is able to accommodate. The present invention aims at utilising in an efficient and beneficial manner for a site operator at least some of the spare processing capacity of a typical processing unit employing a microprocessor as incorporated within a forecourt fuel pump, in order to achieve safer operation of a fuel pump.

According to the present invention, there is provided a forecourt fuel pump including a casing within which is located means for metering and delivering to a flexible hose liquid fuel to be dispensed, and a processing unit arranged to monitor and control the delivery of fuel as well as to display information concerning such delivery, wherein the pump is provided with at least one sensor within the casing for an environmental parameter external to the metering and delivery means, but which parameter is directly concerned with the safety of operation of the pump, the sensor providing an electrical output which is supplied to the processing unit, and the processing unit is arranged to monitor the electrical output and to provide an indication if the sensed value of said parameter falls outside a pre-set range.

The environmental parameter sensed by the sensor may be one of a number of different possible parameters, any one of which might have an effect on the operation of the fuel pump. However, it would be possible for there to be more than one sensor, each of which senses a different environmental parameter, and each such sensor being connected to a respective i/o line of the processing unit. In this way, the fuel pump may be configured to sense its own environment within which it is operating, and either to provide information about that environment or possibly even to shut down operation of the pump in the event that the sensed environment falls outside permissible pre-set ranges.

For example, one of the sensed parameters may be hydrocarbon vapour within the casing of the fuel pump. Hydrocarbon vapour may form an explosive mixture with air, and in the event that there is even a very small leakage of pumped fuel, there can be a potentially dangerous build-up of vapour within the casing of the pump. By having the sensor detect the presence of any such hydrocarbon vapour within the pump casing, a warning to the site operator may be given as soon as the level of vapour rises above a relatively low value. Either simultaneously with that, or if no action is taken to investigate and correct the position, the pump may arrange for all pumping activities to be terminated, in order to minimise the likelihood of a dangerous situation arising.

Another possibility is for the sensor to be arranged to sense the presence of liquid in the lower region of the casing of the fuel pump. The detection may be of any liquid, though particularly hydrocarbons. This is most important in the case of the pumping relatively less volatile fuels, such as diesel fuel. However, an accumulation of water or other liquids in the lower region of a fuel pump could give rise to problems, such as contamination, corrosion, and so on, and thus it is preferred for a sensor to be provided for any liquid accumulating within the casing of the pump.

Yet another possibility is for there to be a sensor for the temperature within the casing of the fuel pump. If the temperature should rise above some pre-determined level, dangerous situations could arise especially where the pump is pumping liquid petroleum spirit. In this case, the processing unit may be arranged to close shut-off valves supplying fuel to the fuel pump as well as closing down the electrical supply to the pump, in order to minimise the risk of a fire. By having the processing unit closing shut-off valves for the fuel, in the event that there is already a fire when the increased temperature is sensed, the likelihood of the fire developing and being fed with fuel is reduced.

Alternatively, or in addition, a sensor may be arranged to sense the temperature of the liquid fuel being pumped. Similar action may be taken if the fuel temperature rises above some pre-set maximum, dependent upon the nature of the fuel, as in the case where the temperature within the pump casing is sensed.

The fuel pump may further be provided with one or more sensors arranged to sense at least one environmental parameter outside the casing of the fuel pump. Such an additional sensor may also provide an electrical output which is supplied to the processing unit, and the processing unit is arranged to monitor the additional electrical output and to provide an indication if the sensed value falls outside a pre-set range. The sensed parameter may also be at least one of hydrocarbon vapour, liquids and temperature, for example in a duct or other housing associated with the supply of fuel to the fuel pump.

The processing unit of the fuel pump may further be provided with a quantity sensor, arranged to sense the quantity of fuel remaining in a storage tank from which the fuel pump draws fuel. Such a quantity sensor may provide a further electrical output which is also supplied to the processing unit of the fuel pump, the processing unit being arranged to monitor that further electrical output and to shut down the pumping of the fuel if the sensed quantity remaining in the storage tank falls below a pre-set value.

Though it is advantageous for the processing unit within a fuel pump to have separate i/o lines for each sensor sensing an environmental parameter associated with the pump, it is possible that more parameters are to be sensed at more locations than there are spare i/o lines and ports on the processing unit. In this case, it is a relatively simple matter to multiplex together various sensor outputs, and to supply the multiplexed signal to a single port of the processing unit, the processing unit running an appropriate programme in order separately to sense the output of each sensor by suitable de-multiplexing of the signal. Conveniently, each multiplexed sensor output is of the same kind—for example hydrocarbon vapour or temperature.

By way of example only, one specific embodiment of a forecourt fuel pump constructed and arranged in accordance with the present invention will now be described in detail, with reference to the accompanying drawings, in which.

Figure 1:
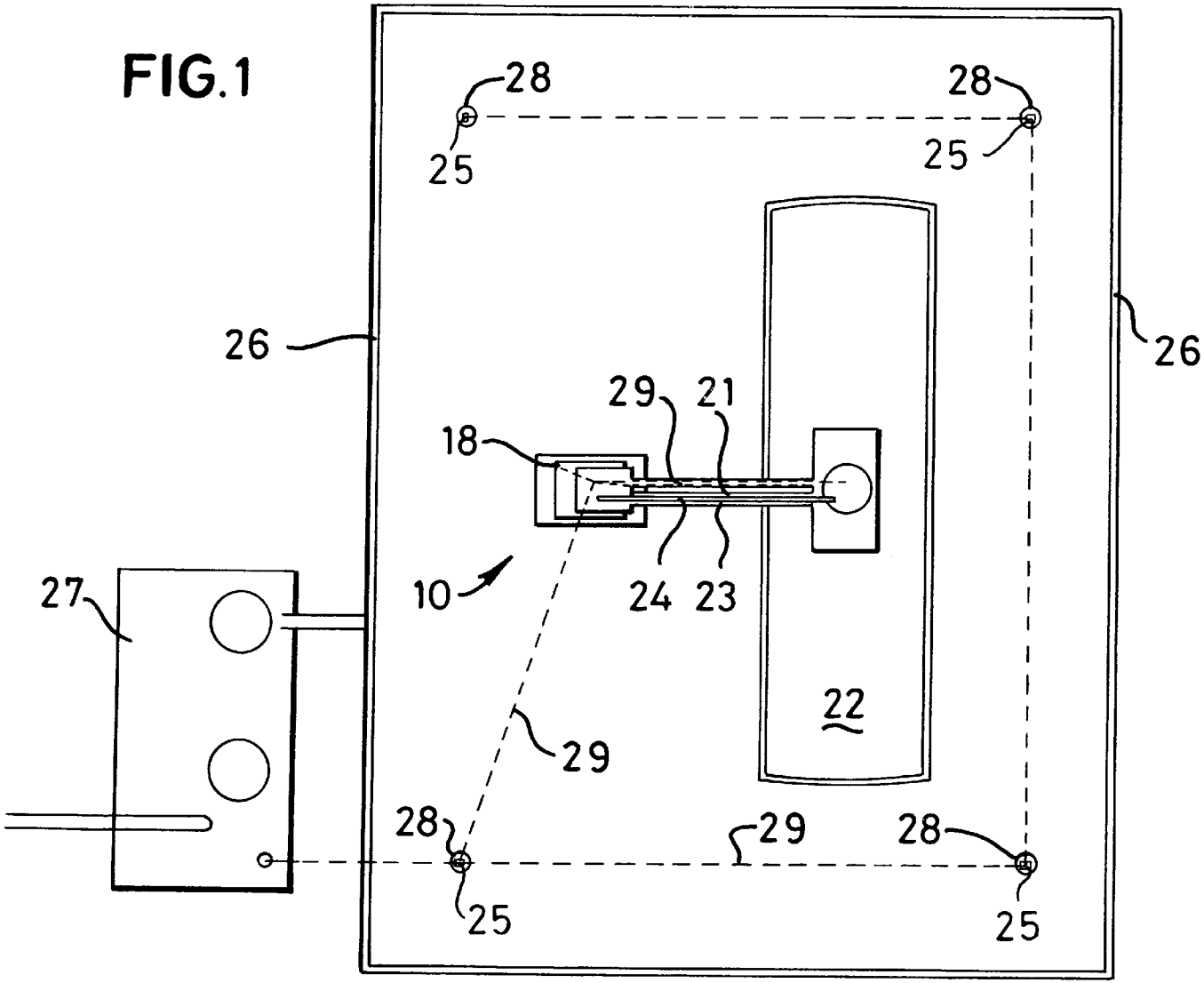
FIG. 1 is a plan view of a forecourt installation including the pump.
Figure 2:
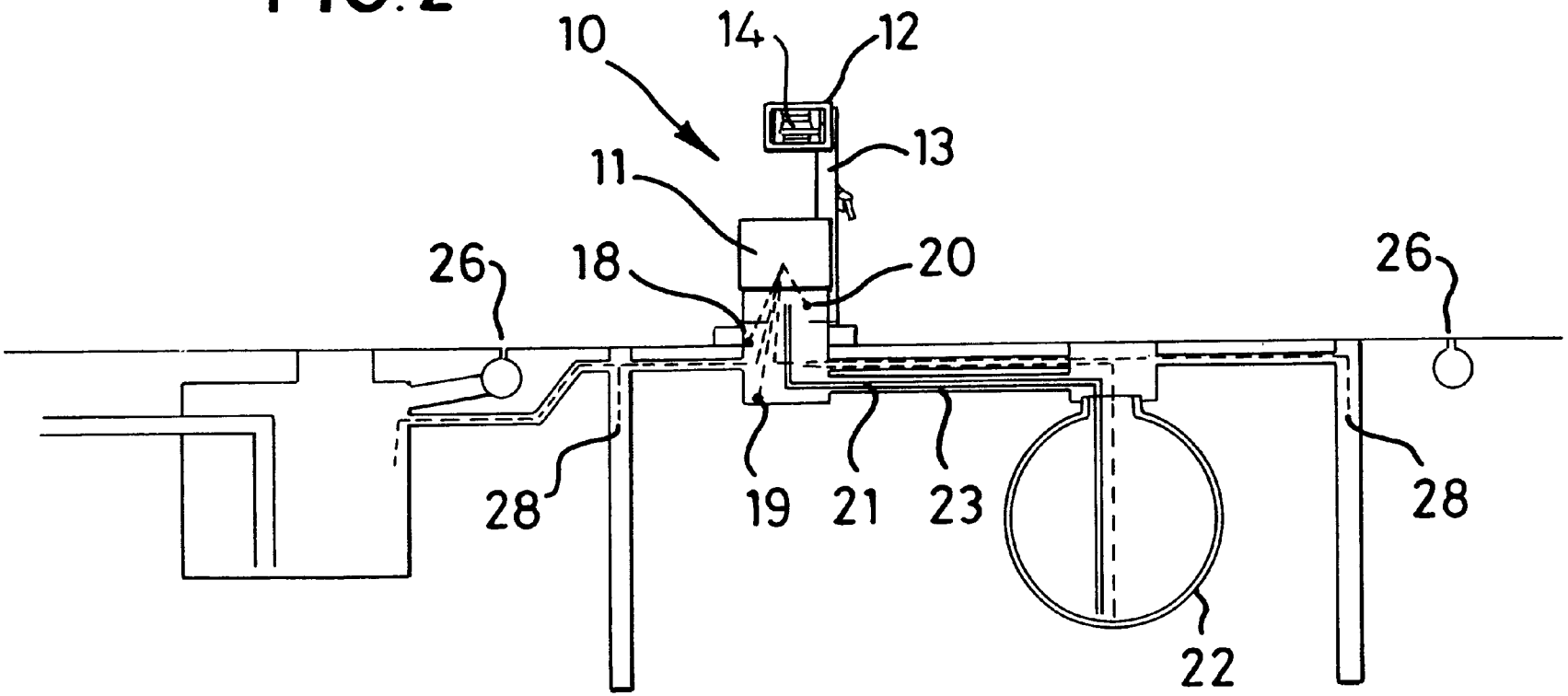
FIG. 2 is a vertical section through the installation shown in FIG. 1.

In the drawings, a conventional modern fuel pump adapted for the metered delivery of petrol, together with the display of the amount delivered, the cost per unit volume and the cost of the delivery is diagrammatically illustrated at 10. The pump includes a casing 11 containing the mechanical components for the pumping of the fuel, and a display cabinet 12 mounted on bracket 13 above the casing 11. Within the display cabinet 12, there is contained a processing unit which receives inputs from various components of the pumping system, and drives a display device 14, for the display of the information mentioned above.

Mounted within the casing is a plurality of sensors 18, 19 and 20, each of which provides an electrical signal for the parameter sensed by the respective sensor. Sensor 18 is arranged to sense hydrocarbon vapour within the casing 11, sensor 19 is arranged to sense the presence of any liquid in the lower region of the casing 11, and sensor 20 is arranged to sense the temperature within the casing.

A pipe 21 connects the fuel pump to an underground storage tank 22, which pipe extends within an underground duct 23. A further sensor 24 is provided within that duct, to sense the presence of any hydrocarbon vapour within that duct. That sensor 24 also provides an electrical signal indicative of any sensed vapour. The electrical signals from all of the sensors 18, 19, 20 and 24 are connected back to the processing unit of the pump.

Further sensors 25 for hydrocarbon vapour may be positioned around the installation, as required. For example, the installation may be surrounded by a slot drain 26 which feeds into an interceptor 27 to separate oils and grease from surface water, before discharging water to a surface-water drain. Hydrocarbon vapour sensors may be positioned within ground-water vapour wells 28 provided in the site within the slot drain 26, and a further such sensor within the interceptor. These sensors may be linked by wires 29, and connected back to the processing unit of the pump.

The processing unit in the pump runs a suitable programme periodically to test the various sensor outputs. The programme also has pre-set therein acceptable values for the sensed parameters, and in the event that any one sensed value falls outside the appropriate range of the pre-set values, the processing unit provides an alarm signal to the site operator. That alarm may be an audible signal, a light signal, or a combination of these. In addition, the processing unit may serve to inhibit further pumping of fuel until the output from the sensors fall back to within the acceptable ranges.

The programme may also have further pre-set values for the sensed parameters, and in the event that any one of the sensed values fall outside the appropriate range of the further pre-set values, the programme may serve immediately to shut down operation not only of the pump within which the processing unit is provided, but also the operation of any other pumps on the same forecourt site. That shutting down operation may include the closing of emergency safety valves in fuel pipelines and the disconnection of electrical supplies to the pumps, back at some centralised location remote from the pumps themselves. In this way, safety in operation may greatly be enhanced, if for example a fire condition is detected, or if dangerous levels of hydrocarbon vapour, leading to explosive mixtures, are detected

What is claimed is:

1. A forecourt fuel pump including a casing, a flexible hose for liquid fuel to be dispensed, a metering and delivery system disposed within the casing for pumping fuel to the flexible hose, and a processing unit arranged to monitor and control the delivery of fuel to the hose as well as to display information concerning the volume and cost of such delivery, wherein the pump is provided with a first sensor within said casing but external to the metering and delivery system, said first sensor being arranged to sense free hydrocarbon vapor within the casing of the fuel pump, said first sensor providing an electrical output dependent upon the concentration of the hydrocarbon vapor within the casing and sensed by said first sensor, and the processing unit is arranged to monitor the electrical output and to provide an indication if the sensed concentration of the hydrocarbon vapor exceeds a pre-set value.

2. A forecourt fuel pump as claimed in claim 1, wherein a second sensor is provided within the casing but external to the metering and delivery system, which second sensor is arranged to sense the presence of liquid within a lower region of the casing of the fuel pump, said second sensor providing an electrical output dependent upon the level of the liquid within the lower region of the casing, and the processing unit is arranged to monitor the electrical output of the second sensor and to provide an indication if the sensed liquid level exceeds a pre-set value.

3. A forecourt fuel pump as claimed in claim 1, wherein the sensor is adapted to sense the presence of both aqueous liquids and hydrocarbon liquids within the lower region of the fuel pump casing.

4. A forecourt fuel pump as claimed in claim 1, wherein a second sensor is provided within the casing but external to the metering and delivery system, which second sensor is arranged to sense the temperature within the casing of the fuel pump, said second sensor providing an electrical output dependent upon the sensed temperature within the casing, and the processing unit is arranged to monitor the electrical output of the second sensor and to provide an indication if the sensed temperature falls outside a pre-set range.

5. A forecourt fuel pump as claimed in claim 1, wherein a second sensor is provided within the casing but external to the metering and delivery system, which second sensor is arranged to sense the temperature of the liquid fuel being pumped, said second sensor providing an electrical output dependent upon the temperature of the fuel, and the processing unit is arranged to monitor the electrical output of the second sensor and to provide an indication if the sensed temperature falls outside a pre-set range.

6. A forecourt fuel pump as claimed in claim 1, wherein there is provided an additional sensor arranged to sense an environmental parameter outside the casing of the fuel pump which parameter is directly concerned with the safety of operation of the fuel pump, the additional sensor providing an additional electrical output which is supplied to the processing unit, and the processing unit is arranged to monitor the additional electrical output and to provide an indication if the sensed value of said environmental parameter falls outside a pre-set range.

7. A forecourt fuel pump as claimed in claim 6, wherein the environmental parameter comprises at least one of hydrocarbon vapour, liquids and temperature in a duct or other housing associated with the supply of fuel to the fuel pump.

8. A forecourt fuel pump as claimed in claim 1, wherein there is provided a quantity sensor for the quantity of fuel remaining in a storage tank from which the pump draws fuel, the quantity sensor providing a further electrical output which is supplied to the processing unit, and the processing unit is arranged to monitor the further electrical output and to shut-down the pumping of fuel if the quantity of fuel falls below a pre-set value.

9. A forecourt fuel pump as claimed in claim 1, wherein the processing unit of the fuel pump is connected to the processing units of further fuel pumps on the same forecourt site, and the operation of the processing units of all of the fuel pumps may be shut down by the processing unit of any one of the fuel pumps, on a sensor of that fuel pump determining a dangerous condition is prevailing at that sensor.

10. A forecourt fuel pump as claimed in claim 9, wherein the processing unit of the fuel pump is connected to a centralised electricity distribution point from which electricity is supplied to said fuel pump, the processing unit being arranged to disconnect the supply of electricity to the pump, at the centralised distribution point, in the event of detection of a dangerous condition prevailing at a sensor associated with said pump.

11. A method of operating a forecourt fuel pump including a casing, a flexible hose for liquid fuel to be dispensed, a metering and delivery system disposed within the casing for pumping fuel to the flexible hose, and a processing unit arranged to monitor and control the delivery of fuel to the hose as well as to display information concerning the volume and cost of such delivery, which pump is provided with a first sensor within said casing but external to the metering and delivery system, said first sensor being arranged to sense free hydrocarbon vapor within the casing of the fuel pump and to provide an electrical output dependent thereon, in which method the processing unit periodically determines the electrical output of said first sensor and compares that electrical output with a pre-determined acceptable range of values for the output from the first sensor, the processing unit providing an indication if the sensed concentration of the hydrocarbon vapor exceeds a pre-set value.

12. A forecourt fuel pump comprising:

a casing;

a flexible delivery hose for fuel to be dispensed;

a liquid fuel metering and delivery system located within the casing and arranged to deliver liquid fuel to the flexible delivery hose;

a processing unit arranged to monitor and control the delivery of fuel by said delivery system, as well as to display information concerning the volume and cost of such delivery;

a first sensor within the casing but external to the metering and delivery system, which first sensor senses free hydrocarbon vapor within the casing of the fuel pump;

a second sensor also provided within the casing but external to the metering and delivery system, which second sensor senses one of temperature within the casing and liquid level within a lower region of the casing;

a further sensor arranged to sense an environmental parameter external to the metering and delivery system, but which parameter is directly concerned with the safety of operation of the fuel pump; and each of said first, second and further sensors providing a respective electrical output which is supplied to the processing unit and the processing unit is arranged to monitor each said electrical output and provide an indication if the output of the respective sensor falls outside a pre-set range.

13. A forecourt fuel pump as claimed in claim 12, wherein said further sensor senses at least one of hydrocarbon vapor, hydrocarbon liquids and temperature in a duct associated with the supply of fuel to the fuel pump.

14. A forecourt fuel pump as claimed in claim 12, wherein said further sensor senses the quantity of fuel remaining in a storage tank from which the fuel pump draws fuel.

* * * * *